US010253533B1

(12) United States Patent
Pudney et al.

(10) Patent No.: US 10,253,533 B1
(45) Date of Patent: Apr. 9, 2019

(54) DOOR HANDLE ASSEMBLY

(71) Applicant: NOVARES US LLC, Livonia, MI (US)

(72) Inventors: Richard Irving Pudney, Plymouth, MI (US); David Brent Egnor, Ypsilanti, MI (US)

(73) Assignee: Novares US LLC, Livonia, MI (US)

( * ) Notice: Subject to any disclaimer, the term of this patent is extended or adjusted under 35 U.S.C. 154(b) by 0 days.

(21) Appl. No.: 15/881,152

(22) Filed: Jan. 26, 2018

(51) Int. Cl.

| | |
|---|---|
| ***E06B 3/00*** | (2006.01) |
| ***E05B 85/10*** | (2014.01) |
| ***E05F 1/10*** | (2006.01) |
| ***E05F 15/63*** | (2015.01) |
| *E05B 81/76* | (2014.01) |

(52) U.S. Cl.
CPC ..... *E05B 85/103* (2013.01); *E05F 1/1016* (2013.01); *E05F 15/63* (2015.01); *E05B 81/76* (2013.01); *E05Y 2900/531* (2013.01)

(58) Field of Classification Search
CPC .... E05B 85/107; E05B 85/16; E05B 85/1033; E05B 85/06; E05B 85/76; E05B 85/08; E05B 81/90; E05B 81/76; E05Y 2600/41; E05Y 2600/46; E05Y 2600/12; E05Y 2600/13; E05Y 2900/531; E05F 15/63; E05F 1/1016
USPC ..... 49/503, 379
See application file for complete search history.

(56) References Cited

U.S. PATENT DOCUMENTS

| | | | | |
|---|---|---|---|---|
| 7,108,301 | B2 * | 9/2006 | Louvel | E05B 81/78 292/201 |
| 9,458,649 | B2 * | 10/2016 | Fujiwara | E05B 81/78 |
| 9,724,985 | B2 * | 8/2017 | Leve | B60J 5/0493 |
| 2004/0031301 | A1 * | 2/2004 | Dominique | E05B 41/00 70/237 |
| 2013/0076048 | A1 * | 3/2013 | Aerts | E05B 85/103 292/336.3 |
| 2013/0170241 | A1 * | 7/2013 | Lesueur | E05B 77/06 362/501 |
| 2014/0300115 | A1 * | 10/2014 | Vasi | E05B 85/103 292/336.3 |
| 2016/0208523 | A1 * | 7/2016 | Bingle | E05B 85/10 |

FOREIGN PATENT DOCUMENTS

| | | | | |
|---|---|---|---|---|
| DE | 102014213184 B3 * | 8/2015 | ..... | E05B 85/14 |

* cited by examiner

*Primary Examiner* — Jerry E Redman
(74) *Attorney, Agent, or Firm* — Butzel Long; George T. Schooff

(57) ABSTRACT

A door handle assembly for a vehicle door is provided that includes: a housing assembly fixedly connected to an outer door panel of the vehicle door having a visible face defining an opening, a cover assembly having a cover and a grip element, the cover assembly is movable between a flush position where the cover element fills the opening and is flush with the visible face and a fully retracted position where the cover element is displaced inwardly from the opening, and the grip element and housing assembly defines an access space to receive fingers of a user, a displacement mechanism to move the cover assembly, and a pin connected to the housing assembly that interacts with a cam profile formed on an external surface of the cover assembly such that the cover assembly follows a path during movement from the flush to fully retracted position.

14 Claims, 6 Drawing Sheets

DOOR HANDLE ASSEMBLY

FIELD

The present disclosure relates to door handle assemblies for a vehicle door.

BACKGROUND

The statements in this section merely provide background information related to the present disclosure and may not constitute prior art.

The trend in automobile design is toward door handles that are flush with the sheet metal body of the vehicle door so that the vehicle has clean, unobstructed body surfaces. Conventional flush door handles are mounted in the vehicle door so that they can pivot between a flush position, in which they substantially fill an opening in the door, and a fully extended outboard position, in which they are outwardly positioned from the opening, thereby leaving an access for the fingers of the user. However, said conventional flush door handles may suffer from various drawbacks. In particular, when the door handle is in its flush position and starts its displacement toward its fully extended outboard position, a risk exists that the handle scrapes the sheet metal body of the vehicle door. To avoid this issue, a solution is to slightly shift inward the handle with respect to the door in the flush position. However, in this case, the handle is no longer flush with the vehicle door.

SUMMARY

The present disclosure provides a door handle assembly for a vehicle door, comprising:

a housing assembly intended to be fixedly connected to an outer door panel of the vehicle door, said outer door panel having a visible face equipped with an opening;

a cover assembly comprising a cover element and a grip element, the cover assembly being movable between a flush position, in which the cover element substantially fills the opening and is substantially flush with the visible face of the outer door panel, and a fully retracted position, in which the cover element is displaced inwardly from the opening and in which the grip element defines in combination with the housing assembly a finger access space adapted to receive the fingers of a user;

a displacement mechanism adapted to move the cover assembly from the flush position to the fully retracted position and vice versa; and a pin fixedly connected to the housing assembly, said pin interacting with a cam profile formed on an external surface of the cover assembly so as to compel the cover assembly to follow a determined path during the movement thereof from the flush position to the fully retracted position and vice versa, thereby inhibiting contact between the cover element and the housing assembly during said movement.

In one form, the displacement mechanism comprises a lever arm pivotally connected to the housing assembly and rotatable about a first pivot axis through a drive mechanism, said lever arm being pivotally connected to the cover assembly about a second pivot axis.

In another form, the drive mechanism comprises a motion arm moving in rotation about a third pivot axis through a motor, said third pivot axis being parallel to the first pivot axis, the motion arm being adapted to push a lug protruding from an external surface of the lever arm.

In still another form, the door handle assembly further comprises a first torsion spring wound around a first pivot shaft and having a first end connected to the housing assembly and a second end connected to the lever arm, said first torsion spring being intended to resist to the movement of the cover assembly from the flush position to the fully retracted position.

In still another form, the door handle assembly further comprises a second torsion spring wound around a second pivot shaft and having a first end connected to the lever arm and a second end connected to the cover assembly, said second torsion spring being intended to urge the cam profile against the pin.

In still another form, the housing assembly comprises an internal face that is opposite to the visible face.

In still another form, a U-shape wall extends perpendicular to said internal face, said U-shape wall comprising a bottom part and two upwardly oriented side wings, respectively a front side wing and a rear side wing, extending respectively at the front side and at the rear side of said bottom part.

In still another form, the bottom part of the U-shape wall is close to the opening and has a central cavity adapted to receive the fingers of one user in the fully retracted position of the cover assembly.

In still another form, each of said front and rear side wings comprises at an upper end thereof a lug provided with a hole suitable to receive the pin that interacts with the cam profile of the cover assembly.

In still another form, the lever arm has a U-shape profile and comprises front and rear lateral wings connected at their upper ends by a strut extending in a front-to-rear direction, said lateral wings being provided at their lower ends by pivot axles adapted to receive first pivot pins defining the first pivot axis.

In still another form, the housing assembly comprises a structure protruding from the internal face, said structure being adapted to fixedly connect a motor shroud enclosing the motor.

In still another form, the motor shroud has an opened end through which extends a motor shaft, the motor being adapted to rotate the motor shaft about the third pivot axis.

In still another form, the cam profile comprises a first portion, a second portion and a third portion, said portions being successively adjacent thereto, the first portion being intended to cooperate with the pin to move the cover assembly from the flush position to a first intermediate position, the second portion being intended to cooperate with the pin to move the cover assembly from the first intermediate position to a second intermediate position, and the third portion being intended to cooperate with the pin to move the cover assembly from the second intermediate position to the fully retracted position.

In still another form, the first portion substantially defines a rectilinear direction that is approximately perpendicular to a plane defined by the visible face in the flush position of the cover assembly, wherein the second portion substantially defines an arc around a fourth pivot axis that is parallel to the first pivot axis, and the third portion substantially defines a rectilinear direction that is approximately parallel to the plane defined by the visible face in the flush position of the cover assembly.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
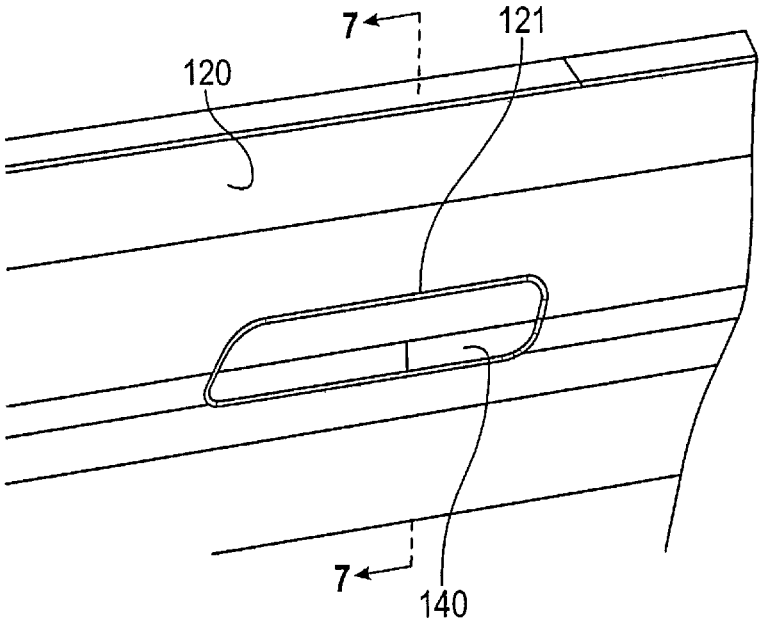
FIG. 1 is an external perspective view of a door handle assembly according to the present disclosure fitted in a door panel, the door handle being flush with said door panel.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The present disclosure provides a door handle assembly for a vehicle door.

It should be understood that the door handle assembly as described herein is characterized with respect to a forward, rearward, upper, and lower orientation, wherein forward is toward a front end of the vehicle, rearward is toward a rear end of the vehicle, external is away from the center of the vehicle and internal is closer to the center of the vehicle. This orientation is for exemplary purposes only and is not meant to limit the present disclosure in any manner. It will be apparent to one of ordinary skill in the vehicular handle art that the door handle assembly can be positioned on a vehicle door in any suitable fashion.

Referring now to FIGS. 1 to 6 and 7A-7D, the present disclosure is described in relation to one form thereof.

FIG. 1 illustrates the door handle assembly when it is flush with the adjacent outboard surface 120 of an outer door panel. In this flush position, a cover element 140 extends into a door handle cutout 121 in the outer door panel. The external shape of the cover element 140 substantially matches the shape of the door panel cutout 121, so that the aesthetic aspect of the outer door panel is not affected.

Figure 2:
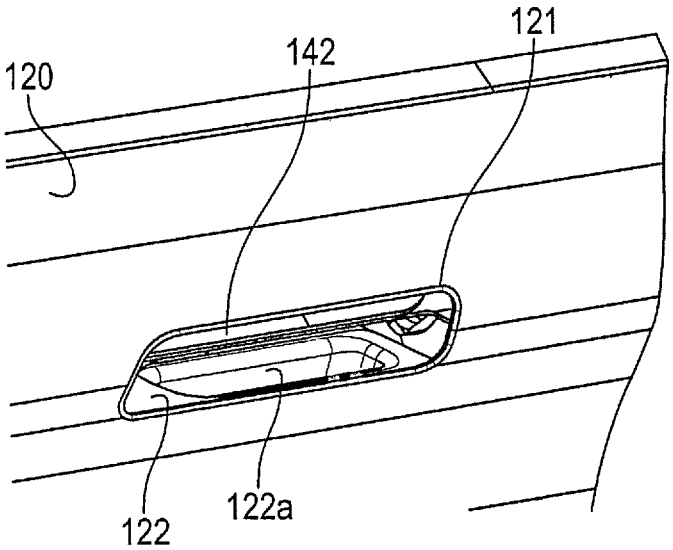
FIG. 2 is an external perspective view similar to FIG. 1, with the door handle being fully retracted in the door panel.

FIG. 2 illustrates the door handle assembly when it is in a fully retracted position. In this position, the cover element 140 has been moved inside the vehicle door, thus freeing the area defined by the door handle cutout 121. This door handle cutout 121 provides an access for one user's hand to the internal side of the door handle assembly. In particular, the door handle assembly advantageously comprises a grip element 142 that is disposed in the fully retracted position of FIG. 2 above a housing support 122 having a central cavity 122*a*, said grip element 142 and said central cavity 122*a* being adapted to receive the fingers of one user.

Figure 3:
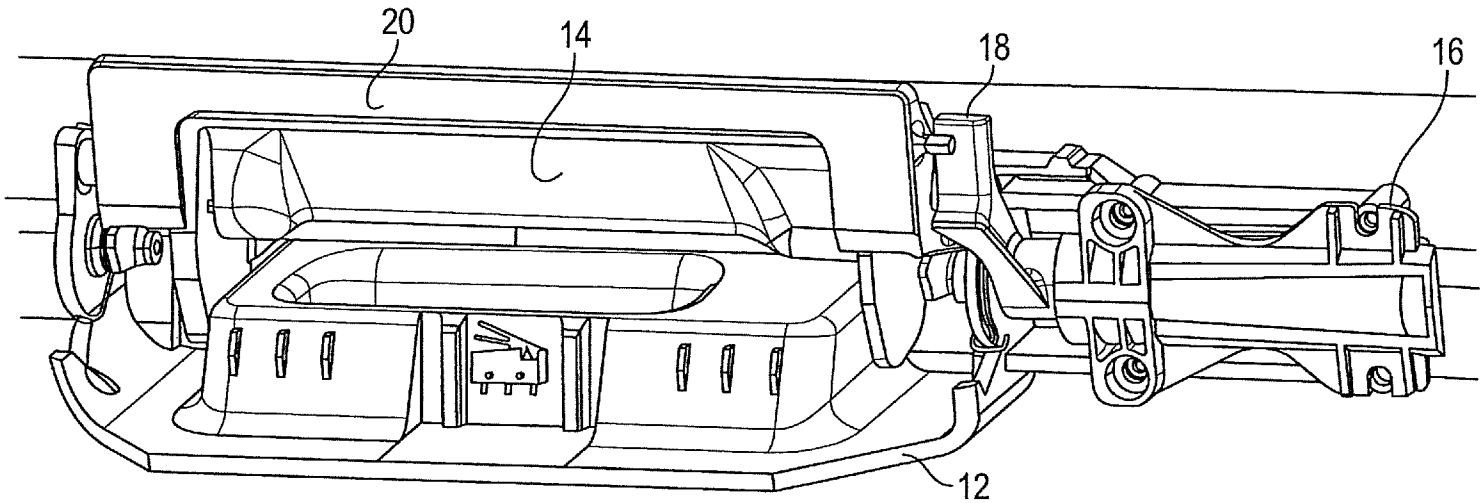
FIG. 3 is an internal perspective view of a door handle assembly according to the present disclosure in a flush position.
Figure 4:
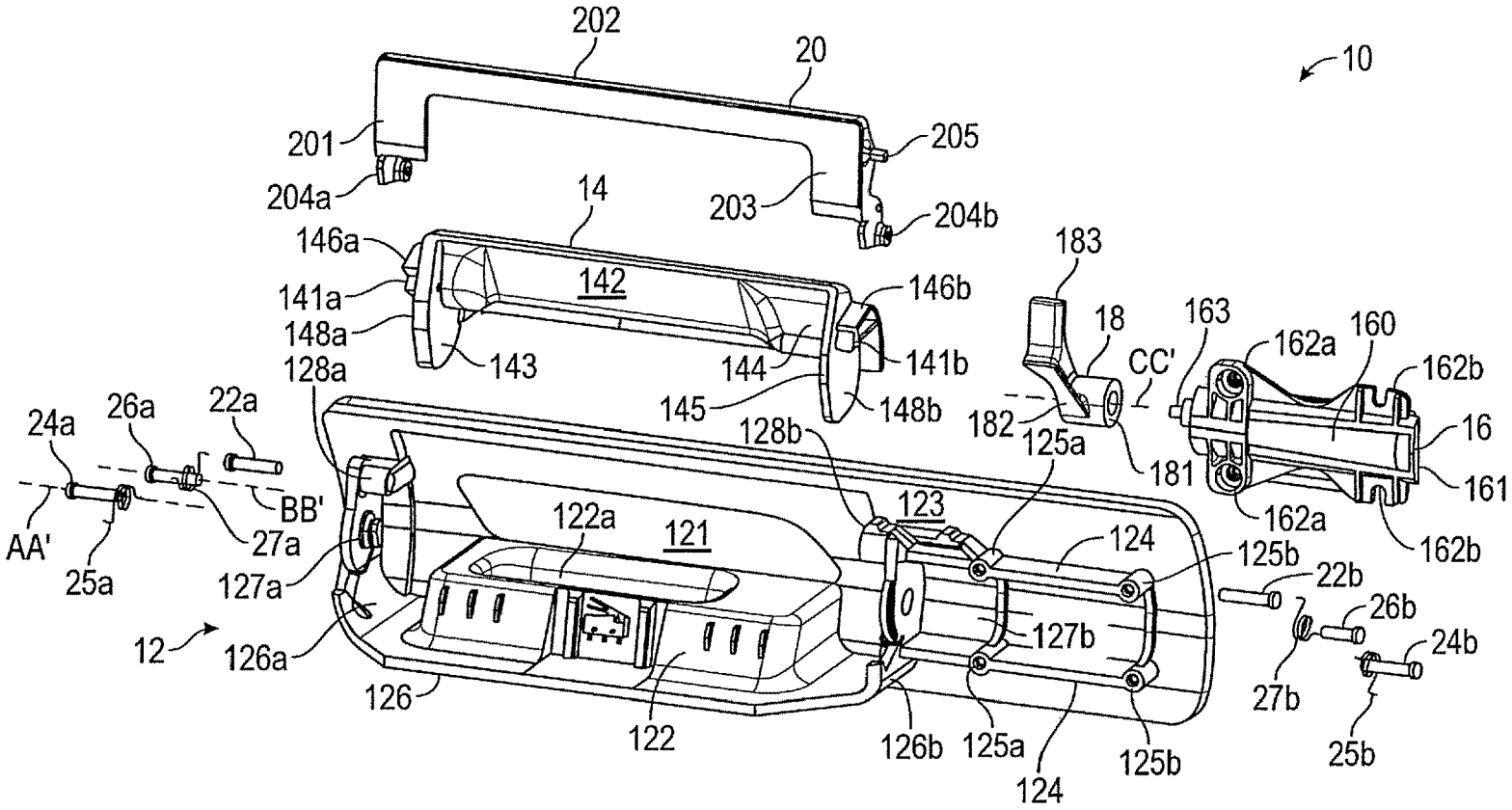
FIG. 4 is an exploded perspective view of the door handle assembly shown in FIG. 3.

FIGS. 3 and 4 illustrate the different constituting elements of the door handle assembly of the present disclosure, when viewed from inside the vehicle door.

As shown, the door handle assembly 10 includes five main subcomponents, namely, a housing assembly 12, a cover assembly 14, a motor assembly 16, a motion arm 18 and a lever arm 20.

The housing assembly 12 is seated in the outer door panel and is fixedly connected thereto. Thus, the housing assembly 12 comprises an internally oriented surface 123 that is opposite to the externally oriented surface 120 shown in FIGS. 1 and 2. Perpendicular to said internal surface 123 extends a transversal U-shape wall 126, comprising a bottom part forming the housing support 122 and two upwardly oriented side wings 126*a*, 126*b*, respectively a front side wing 126*a* and a rear side wing 126*b*, extending respectively at the front side and at the rear side of said bottom part. Each side wing 126*a*, 126*b* defines at an upper end thereof a lug 128*a*, 128*b* provided with a hole suitable to receive a pin 22*a*, 22*b*, each pin 22*a*, 22*b* protruding from its respective lug 128*a*, 128*b* in the direction of the other pin 22*a*, 22*b* so as to interact with a cam profile 146*a*, 146*b* of the cover assembly 14, as detailed in the following paragraphs. Each side wing 126*a*, 126*b* also forms substantially in its middle part a first pivot pin support 127*a*, 127*b* provided with a through-hole suitable to receive a first pivot pin 24*a*, 24*b*. First pivot pins 24*a* and 24*b* are also received in respective though-holes of corresponding pivot axles 204*a*, 206*b* provided at the lower ends of front and rear lateral wings 201, 203 of the U-shape lever arm 20, said lateral wings 201, 203 being connected at their upper ends by a strut 202 extending in a front-to-rear direction. Such an assembly pivotally connects the lever arm 20 to the housing assembly 12 about a first pivot axis AA' defined by the first pivot pins 24*a*, 24*b*. First torsion springs 25*a*, 25*b* are respectively wound around said first pivot pin supports 127*a*, 127*b*, each first torsion spring 25*a*, 25*b* having a first end 251 that is received within a notch 129 formed in each side wing 126*a*, 126*b* and a second end 252 that is connected to the lever arm 20, said first torsion springs 25*a*, 25*b* being thus adapted to resist to the rotary movement of the lever arm 20 around the first pivot axis AA'.

The housing assembly 12 also comprises a structure formed by two parallel brackets 124 protruding from the internally oriented surface 123, said brackets 124 being oriented along a front-to-rear direction. Each bracket 124 comprises a pair of threads 125*a*, 125*b* intended to receive the threaded rod of a screw (not shown), the screw being partially received inside corresponding through-holes 162*a*, 162*b* of an external shroud 161 of the motor assembly 16, thus fixedly connecting the motor assembly 16 to the housing assembly 12. The external shroud 161 encloses a motor 160, the motor 160 having a motor shaft 163 extending through the external shroud 161 at a front end thereof. The motor 160 is adapted to rotate the motor shaft 163 in a clockwise direction about a pivot axis CC' that is parallel to the first pivot axis AA', the clockwise direction corresponding to the direction of the rotation of the motor shaft 163 when viewed from the front of the motor assembly 16. The motion arm 18 includes a tubular lower end 181 forming a bore, within which the motor shaft 163 is secured, thus permitting a pivotal displacement of the motion arm 18 about the pivot axis CC'.

Figure 5:
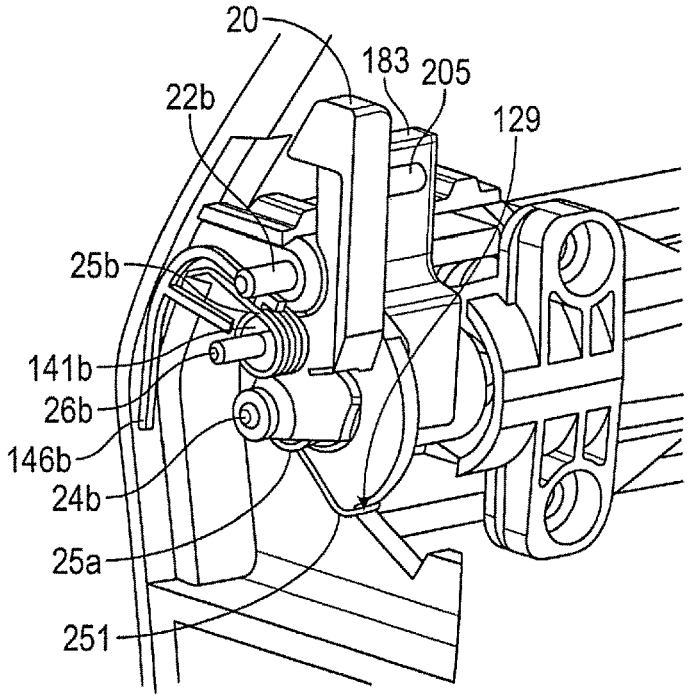
FIG. 5 is a cross-sectional perspective view of a portion of the door handle assembly shown in FIG. 3.
Figure 6:
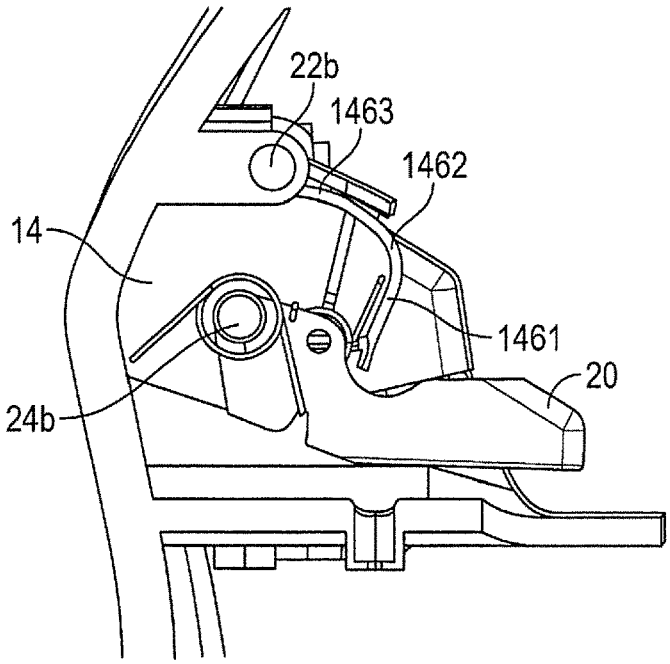
FIG. 6 is a side view of the portion of the door handle assembly shown in FIG. 5, in a fully retracted position of a door handle.

As best shown in FIG. 5, the motion arm 18 further comprises a L-shaped upper end 183 connected to the lower end 181 by a curved cross-piece 182. This upper end 183 is positioned so as to be parallel and slightly spaced in the front-to-rear direction from the rear wing 203 of the lever arm 20. The motion arm 18 is advantageously disposed relative to the lever arm 20 so that the upper end 183 is positioned behind and in one form in contact with a lug 205 protruding from the side face of the rear wing 203 that faces said upper end 183. Thus, when the motion arm 18 clockwise rotates about the pivot axis CC' under the action of the motor 160, the upper end 183 pushes the lug 205, thus clockwise rotating the lever arm 20 about the first pivot axis AA'. When the motor 160 is shut down, the lever arm 20 counterclockwise rotates about the first pivot axis AA' under the action of the first torsion springs 25*a*, 25*b* till the lever arm 20 abuts against the internal surface 123 of the housing assembly 12, thus positioning the door handle assembly 10 in the flush position illustrated in FIG. 3.

Figure 7A:
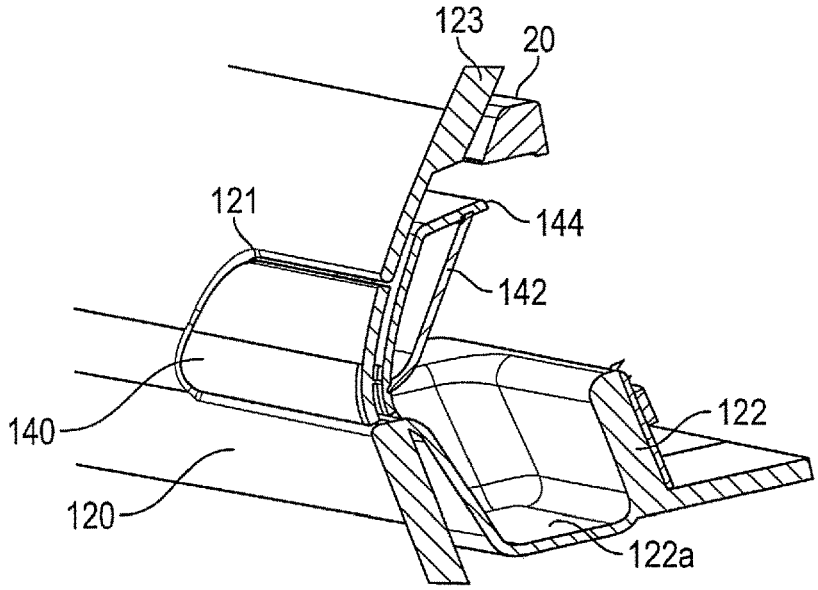
FIG. 7A is a cross-sectional perspective view of a door handle assembly in a flush position according to the present disclosure.

The cover assembly 14 has a substantially U-shaped profile and comprises a front strut 143, a rear strut 145 and a top strut 144. As best shown in FIG. 7A, the top strut 144 supports internally the grip element 142 and externally the cover element 140. Any means of connection may be used to fixedly connect the cover and grip elements 140, 142 to the top strut 142. For instance, an adhesive connection or a snap-fit connection may be used. The front and rear struts 143, 145 respectively support a front pivot axle 141*a* and a rear pivot axle 141*b*, each one of said pivot axles 141*a*, 141*b* being provided with a through-hole inside which is respectively received a front second pivot pin 26*a* and a rear second pivot pin 26*b*. These pivot pins are thus aligned in a front-to-rear direction, said direction defining a second pivot axis BB' that is parallel to the first pivot axis AA'. As best shown in FIG. 5, the lever arm 20 is provided with a front lug and a rear lug (not shown) respectively protruding from rearwardly oriented and forwardly oriented surfaces of the front and rear struts 201, 203, said front and rear lugs being provided with corresponding through-holes adapted to receive the front and the rear second pivot pins 26*a*, 26*b*, thus permitting a pivotal connection of the cover assembly 14 relative to the lever arm 20 about the second pivot axis BB'.

The cover assembly 14 further comprises a pair of cam profiles 146*a*, 146*b*, respectively a front cam profile 146*a* formed on a frontwardly oriented surface 148*a* of the front strut 143 and a rear cam profile 146*b* formed on a rearwardly oriented surface 148*b* of the rear strut 145. Each cam profile 146*a*, 146*b* is disposed adjacent to a respective lug 128*a*, 128*b* of the housing assembly 12 and in contact with a pin 22*a*, 22*b* protruding from said lug 128*a*, 128*b*. Therefore, when the motion arm 18 clockwise pivots around the pivot axis CC' under the action of the motor 160, it pushes the lug 205 which leads to the rotary movement of the lever arm 20 around the first pivot axis AA'. Due to the pivoting connection between the lever arm 20 and the cover assembly 14, this rotary movement leads to a complex movement of the cover assembly 14 during which the pins 22*a*, 22*b* follow the contour of the cam profiles 146*a*, 146*b*. The specific path followed by said cover assembly 14 is determined by the interaction between the pins 22*a*, 22*b* and the cam profiles 146*a*, 146*b*. As best shown in FIG. 5, second torsion springs 27*a*, 27*b* are respectively wound around front and rear pivot axles 141*a*, 141*b* of the cover assembly 14, each second torsion spring 27*a*, 27*b* having a first end 271 connected to the lever arm 20 and a second end 272 connected to the cover assembly 14, said second torsion springs 27*a*, 27*b* being adapted to urge the cam profiles 146*a*, 146*b* against the corresponding pins 26*a*, 26*b*.

FIGS. 7A to 7D illustrate several successive positions of the cover assembly 14 during its complex movement from the flush position to the fully retracted position.

FIG. 7A shows the cover assembly 14 when the cover element 140 is flush with the visible face 120 of the outer door panel. In this flush position, the cover element 140 substantially fills the opening 121, the lever arm 20 is biased against the internal surface 123 of the housing assembly 12 under the action of the first torsion springs 25*a*, 25*b* and the grip element 142 is inwardly oriented toward the central cavity 122*a* of the housing support 122. The motion arm 18 is positioned in a rest position in which it abuts against the lug 205. The motor 160 is shut down.

Figure 7B:
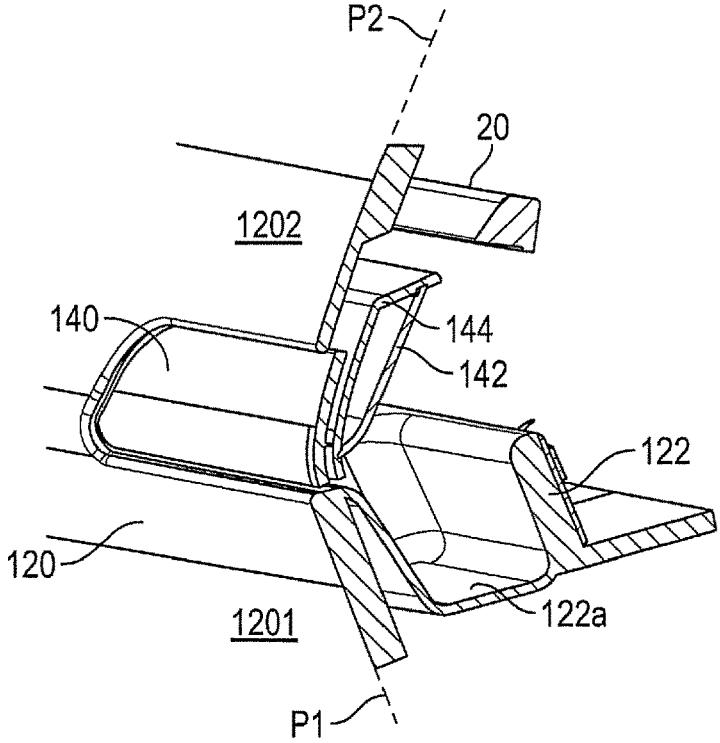
FIG. 7B is a cross-sectional perspective view of a door handle assembly in a slightly retracted position according to the present disclosure.

FIG. 7B shows the cover assembly 14 just after the motor 160 is started. The lever arm 20 has been rotatably moved about the first pivot axis AA' under the action of the motion arm 18. Simultaneously, the cover assembly 14 has been internally moved so that the cover element 140 begins to release the free space defined by the opening 121. During this movement, the cover element 140 follows a trajectory that may approximately be defined as the successive combination of a first translation in a direction perpendicular to a plane P1 defined by a lower part 1201 of the visible face 120 that is positioned just under the opening 121 and a second translation in a direction perpendicular to a plane P2 defined by an upper part 1202 of the visible face 120 that is positioned just above the opening 121. Such a specific trajectory is adapted to inhibit any contact between the cover element 140 and the housing assembly 12. This specific trajectory results from the interaction of the pins 22*a*, 22*b* with a first portion 1461 of the cam profiles 146*a*, 146*b*. This first portion 1461 substantially defines a rectilinear direction that is approximately perpendicular to the plane P2 in the flush position of the cover assembly 14 (see FIGS. 5 and 6).

Figure 7C:
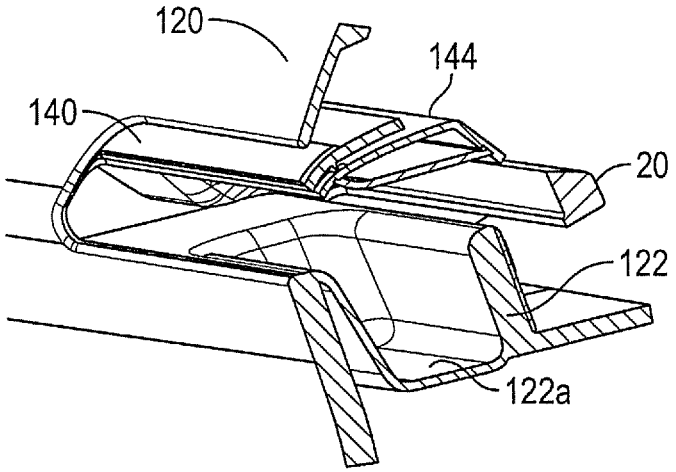
FIG. 7C is a cross-sectional perspective view of a door handle assembly in a partially retracted position according to the present disclosure.

FIG. 7C shows the cover assembly 14 a few moments later after the start of the motor 160. The lever arm 20 has been further moved about the first pivot axis AA' under the action of the motion arm 18. Simultaneously, the cover assembly 14 has continued to move inside the housing assembly 12 so that the free space defined by the opening 121 is half released by the cover element 140. During this movement, the cover element 140 follows a trajectory that may approximately be defined as a rotation around a pivot axis that is parallel to the first pivot axis AA'. This specific trajectory results from the interaction of the pins 22*a*, 22*b* with a second portion 1462 of the cam profiles 146*a*, 146*b*. This second portion 1462 substantially defines an arc around the said pivot axis (see FIGS. 5 and 6).

Figure 7D:
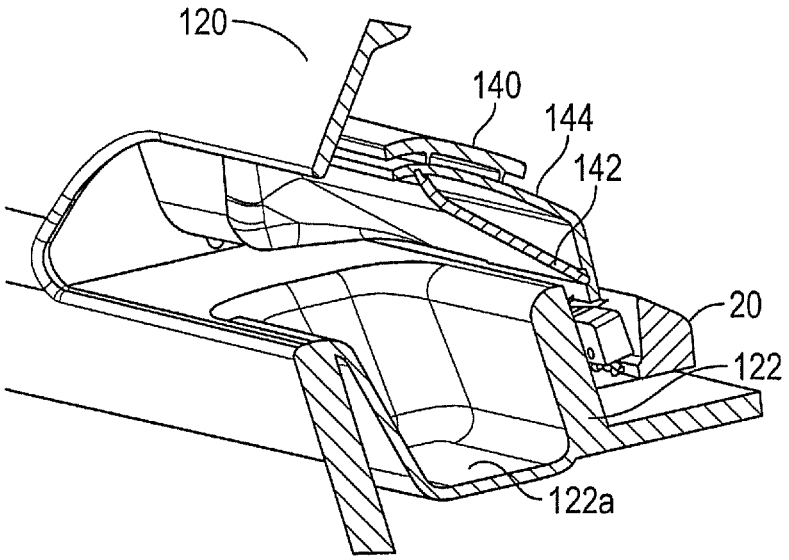
FIG. 7D is a cross-sectional perspective view of a door handle assembly in a fully retracted position according to the present disclosure.

FIG. 7D shows the cover assembly 14 a further few moments later after the start of the motor 160. The lever arm 20 has been further moved about the first pivot axis AA' under the action of the motion arm 18. Simultaneously, the cover assembly 14 has been further internally moved so as to reach the fully retracted position shown in FIG. 2. During this movement, the cover element 140 follows a trajectory that may approximately be defined as a rotation around a pivot axis that is parallel to the first pivot axis AA'. This specific trajectory results from the interaction of the pins 22*a*, 22*b* with a third portion 1463 of the cam profiles 146*a*, 146*b*. This third portion 1463 substantially defines a rectilinear direction that is approximately parallel to the plane P2 in the flush position of the cover assembly 14 (see FIGS. 5 and 6).

The operation of the door handle assembly will now be briefly described. Initially, the door handle assembly is in the position illustrated in FIG. 1, the cover element 140 being flush with the door panel. A control system of the vehicle determines if a key fob receiver detects if a user is approaching the vehicle door or if a key fob button is pressed by the user. If not, the cover element 140 is kept in the flush position. If yes, the control system actuates the motor 160 till the cover element 140 is fully retracted inside the door panel. Afterwards, the user can access to the central cavity 122*a*, inside which he can put his fingers to actuate a sensor that electronically unlatches the door and/or to pull the door when the door is unlatched. Thereafter, the control system detects if the door is closed and/or if the user is far from the door, and, if the detection is positive, the control system stops the motor 160 which leads to the return movement of the cover assembly 14 in the flush position under the action of the first torsion springs 25*a*, 25*b*.

The description of the disclosure is merely exemplary in nature and, thus, variations that do not depart from the substance of the disclosure are intended to be within the scope of the disclosure. Such variations are not to be regarded as departure from the spirit and scope of the disclosure.

What is claimed is:

1. A door handle assembly for a vehicle door, said handle assembly comprising:

a housing assembly fixedly connected to an outer door panel of the vehicle door, said outer door panel having a visible face having an opening;

a cover assembly comprising a cover element and a grip element, the cover assembly being movable between a flush position, in which the cover element substantially fills the opening and is substantially flush with the visible face of the outer door panel, and a fully retracted position, in which the cover element is displaced inwardly from the opening, wherein the grip element and the housing assembly define a finger access space adapted to receive fingers of a user;

a displacement mechanism adapted to move the cover assembly between the flush position and the fully retracted position; and at least one pin fixedly connected to the housing assembly, said at least one pin configured to interact with at least one cam profile formed on an external surface of the cover assembly, said interaction causing the cover assembly to follow a determined path when moving between the flush position and the fully retracted position, wherein the cover element does not make contact with the housing assembly when said cover assembly moves between the flush position and the fully retracted position.

2. The door handle assembly of claim 1, wherein the displacement mechanism comprises a lever arm pivotally connected to the housing assembly and rotatable about a first pivot axis through a drive mechanism, said lever arm being pivotally connected to the cover assembly about a second pivot axis.

3. The door handle assembly of claim 2, wherein the drive mechanism comprises a motion arm operable to move in rotation about a third pivot axis through a motor, said third pivot axis being parallel to the first pivot axis, the motion arm adapted to push a lug protruding from an external surface of the lever arm.

4. The door handle assembly of claim 2 further comprising a first torsion spring wound around a first pivot shaft and having a first end connected to the housing assembly and a second end connected to the lever arm, said first torsion spring configured to resist movement of the cover assembly from the flush position to the fully retracted position.

5. The door handle assembly of claim 4 further comprising a second torsion spring wound around a second pivot shaft and having a first end connected to the lever arm and a second end connected to the cover assembly, said second torsion spring configured to urge the at least one cam profile against the at least one pin.

6. The door handle assembly of claim 2, wherein the lever arm has a U-shape profile comprising front and rear lateral wings each having an upper end, said front and rear lateral wings connected at their upper ends by a strut extending in a front-to-rear direction, said front and rear lateral wings each having pivot axles at a lower end, said pivot axles adapted to receive first pivot pins defining a first pivot axis.

7. The door handle assembly of claim 1, wherein the housing assembly comprises an internal face that is opposite to the visible face.

8. The door handle assembly of claim 7, wherein a U-shape wall extends perpendicular to said internal face, said U-shape wall comprising a bottom part and upwardly oriented front and rear side wings, wherein the front side wing extends at a front side of said bottom part and the rear side wing extends at a rear side of said bottom part.

9. The door handle assembly of claim 8, wherein the bottom part of the U-shape wall is disposed proximate the opening and includes a central cavity adapted to receive the fingers of the user when the cover assembly is in the fully retracted position.

10. The door handle assembly of claim 8, wherein each of said front and rear side wings comprises at an upper end defining a lug having a hole operable to receive the at least one pin that interacts with the cam profile of the cover assembly.

11. The door handle assembly of claim 7, wherein the housing assembly comprises a structure protruding from the internal face, said structure adapted to fixedly connect a motor shroud enclosing a motor.

12. The door handle assembly of claim 11, wherein a motor shaft extends through an open end of the motor shroud, the motor adapted to rotate the motor shaft about a third pivot axis.

13. The door handle assembly of claim 1, wherein the cam profile comprises a first portion, a second portion and a third portion, said first, second, and third portions successively adjacent to each other, wherein the first portion is operable to cooperate with the at least one pin to move the cover assembly from the flush position to a first intermediate position, wherein the second portion is operable to cooperate with the at least one pin to move the cover assembly from the first intermediate position to a second intermediate position, and wherein the third portion is operable to cooperate with the at least one pin to move the cover assembly from the second intermediate position to the fully retracted position.

14. The door handle assembly of claim 13, wherein the first portion defines a rectilinear direction that is approximately perpendicular to a plane defined by the visible face in the flush position of the cover assembly, wherein the second portion defines an arc around a fourth pivot axis that is parallel to a first pivot axis, and wherein the third portion defines a rectilinear direction that is approximately parallel to the plane defined by the visible face in the flush position of the cover assembly.

* * * * *